US011318750B2

(12) United States Patent
Chen et al.

(10) Patent No.: US 11,318,750 B2
(45) Date of Patent: May 3, 2022

(54) FLUID PROPERTY SENSOR

(71) Applicant: HEWLETT-PACKARD DEVELOPMENT COMPANY, L.P., Spring, TX (US)

(72) Inventors: Chien-Hua Chen, Corvallis, OR (US); Michael W Cumbie, Corvallis, OR (US); Anthony D. Studer, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/605,088

(22) PCT Filed: Oct. 18, 2017

(86) PCT No.: PCT/US2017/057097
§ 371 (c)(1),
(2) Date: Oct. 14, 2019

(87) PCT Pub. No.: WO2019/078835
PCT Pub. Date: Apr. 25, 2019

(65) Prior Publication Data

US 2021/0129550 A1 May 6, 2021

(51) Int. Cl.
*B41J 2/175* (2006.01)

(52) U.S. Cl.
CPC ..... *B41J 2/17566* (2013.01); *B41J 2/17503* (2013.01); *B41J 2/17513* (2013.01)

(58) Field of Classification Search
CPC B41J 2/17503; B41J 2/17513; B41J 2/17566; B41J 2/195; G01F 23/0069
See application file for complete search history.

(56) References Cited

U.S. PATENT DOCUMENTS 5,836,007 A * 11/1998 Clinton ..... H01L 27/112 365/205
6,007,173 A 12/1999 DeLouise et al.
6,431,670 B1 8/2002 Schantz et al.
7,556,326 B2 7/2009 Knierim et al.
2005/0126282 A1 6/2005 Maatuk
(Continued)

FOREIGN PATENT DOCUMENTS

CN 2136463 Y 6/1993
CN 2540624 Y 3/2003
(Continued)

OTHER PUBLICATIONS

Hammond, P.A. et al.,Encapsulation of a Liquidsensing Microchip Using SU-8 Photoresist, Jun. 2004, < http://www.sciencedirect.com/science/article/pii/S0167931704002400 >.

*Primary Examiner* — Anh T Vo
(74) *Attorney, Agent, or Firm* — Trop Pruner & Hu PC

(57) ABSTRACT

In one example, a fluid property sensor includes an electrical circuit assembly (ECA), an elongated circuit (EC), and an external interface. The EC is attached to the ECA and includes multiple point sensors distributed along a length of the EC. The external interface is electrically coupled to a proximal end of the EC. The EC and the external interface are packaged together with an encasement on both sides of the ECA to form the fluid property sensor.

20 Claims, 11 Drawing Sheets

(56) References Cited

U.S. PATENT DOCUMENTS

| | | | |
|---|---|---|---|
| 2008/0107151 | A1 | 5/2008 | Khadkikar et al. |
| 2016/0202103 | A1 | 7/2016 | Heinonen et al. |
| 2017/0182786 | A1 | 6/2017 | Navarro et al. |
| 2019/0126632 | A1* | 5/2019 | Anderson ..... G01F 23/0069 |

FOREIGN PATENT DOCUMENTS

| | | | |
|---|---|---|---|
| EP | 2881724 | A1 | 6/2015 |
| EP | 2947444 | B1 | 11/2015 |
| EP | 3076147 | A1 | 10/2016 |
| JP | S63204120 | A | 8/1988 |
| JP | H03284953 | A | 12/1991 |
| WO | WO-9211513 | A1 | 7/1992 |
| WO | WO2017074342 | A1 | 5/2017 |

* cited by examiner

FLUID PROPERTY SENSOR

CROSS-REFERENCE TO RELATED APPLICATIONS

This Application is related to commonly assigned PCT Applications PCT/US2016/028642, filed Apr. 21, 2016, entitled "LIQUID LEVEL SENSING", PCT/US2016/028637, filed Apr. 21, 2016, entitled "FLUID LEVEL SENSING WITH PROTECTIVE MEMBER", PCT/US2016/028624, filed Apr. 21, 2016 entitled "FLUID LEVEL SENSOR", PCT/US2016/044242, filed Jul. 27, 2016, entitled "VERTICAL INTERFACE FOR FLUID SUPPLY CARTRIDGE HAVING DIGITAL FLUID LEVEL SENSOR", and PCT International Publication WO2017/074342A1, filed Oct. 28, 2015, entitled "LIQUID LEVEL INDICATING" all of which are hereby incorporated by reference within.

BACKGROUND

Accurate fluid level sensing has generally been complex and expensive. Accurate fluid levels can prevent fluid waste and premature replacement of fluid tanks and fluid-based devices, such as inkjet printheads. Further, accurate fluid levels prevent low-quality fluid-based products that may result from inadequate supply levels, thereby also reducing waste of finished products.

BRIEF DESCRIPTION OF THE DRAWINGS

The disclosure is better understood with reference to the following drawings. The elements of the drawings are not necessarily to scale relative to each other. Rather, the emphasis has instead been placed upon clearly illustrating the claimed subject matter. Furthermore, like reference numerals designate corresponding similar parts, but perhaps not identical, through the several views. For brevity, some reference numbers described in earlier drawings may not be repeated in later drawings.

DETAILED DESCRIPTION

This disclosure relates to a new type of inexpensive fluid property sensor that incorporates a narrow elongated (aka 'sliver') circuit (EC) with multiple sensors mounted on a substrate and packaged to protect any bond wires and EC circuitry better than chip-on-board techniques. The elongated circuit may be a semiconductor integrated circuit (IC), a hybrid circuit, or other fabricated circuit having multiple electrical and electronic components fabricated into an integrated package. This new fluid sensor can provide substantially increased resolution and accuracy over conventional point sensors by placing a high density of exposed sets of multiple point sensors along the length of the elongated circuit. Multiple ECs may be arranged in a daisy chain fashion (staggering being one example) to create a long fluid property sensor covering the depth of fluid in a container. The multiple ECs may share a common interface bus and may include test circuitry, security, bias, amplification, and latching circuitry.

The sets of multiple sensors may be distributed non-linearly to allow for increasing resolution when a fluid cartridge has a low amount of fluid. Further, the sets of multiple sensors may be configured to be read in parallel to increase surface contact with the fluid for some applications or strobed individually in other applications. Not only levels of the fluid may be sensed, but complex impedance measurements may be taken. Additional sensors 85, 86 can be configured or added for property sense of the fluid (e.g., ink type, pH) and temperature sense of the fluid. The multiple ECs may be of the same type or different types depending on desired properties of the fluid sensor. One of the multiple ECs may contain the container driver circuit with memory (aka acumen chip), or the container driver circuit may be on a separate IC with an aspect ratio of less than 1:10 or a non-elongated circuit and coupled to the common interface bus. Several different examples and descriptions of various techniques to make and use the claimed subject matter follow below.

Figure 1A:
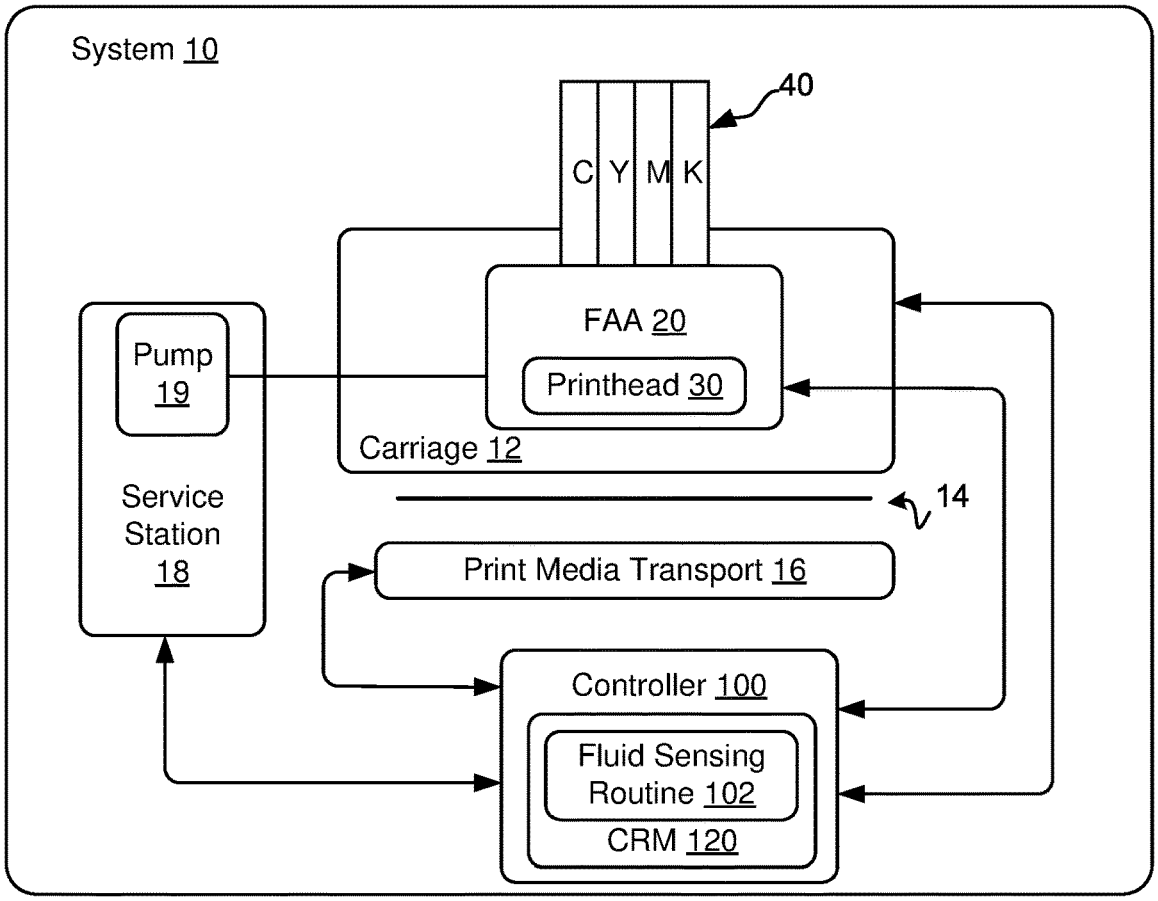
FIG. 1A is a block diagram of an example fluid-based system.

FIG. 1A is a block diagram of an example fluid-based system 10, such as an inkjet printer. System 10 may include a carriage 12 with a fluid actuation assembly (FAA) 20 having a printhead 30. The FAA 20 may also include one or more fluid containers 40. In this example, there are four fluid containers 40 with Cyan (C), Yellow (Y), Magenta (M), and Black (K) ink. Other colors may be used. The ink may be dye or pigment based or combinations thereof. The FAA 20 may be located on a stationary carriage 12 such as with a page-wide array system 10, or it may be located on a movable carriage 12, and the printhead 30 scanned in one or more directions across a media 14.

The media 14 is moved using a print media transport 16, typically from a media tray to an output tray. The print media transport 16 is controlled by a controller 100 to synchronize the movement of the media 14 with any movement and/or actuation of printhead 30 to place fluid on the media 14 accurately. The controller 100 may have one or more processors having one or more cores and may be distributed partially or fully across one or more driver circuits 204 (FIG. 12C) on fluid property sensor 46. The controller 100 is coupled to a tangible and non-transitory computer-readable medium (CRM) 120 that stores instructions readable by and executed by the controller 100. The CRM 120 may include several different routines to operate and control the system 10. One such routine may be a fluid sensing routine 102 (see FIG. 16) used to monitor and measure fluid levels and/or fluid characteristics in one of the FAA 20 and fluid containers 40.

A computer-readable medium 120 allows for storage of one or more sets of data structures and instructions (e.g., software, firmware, logic) embodying or utilized by any one or more of the methodologies or functions described herein. The instructions may also reside, completely or at least partially, within the static memory, the main memory, and/or within a processor of controller 100 during execution by the system 10. The main memory, driver circuit 204 memory, and the processor memory also constitute computer-readable medium 120. The term "computer-readable medium" 120 may include single medium or multiple media (centralized or distributed) that store the one or more instructions or data structures. The computer-readable medium 120 may be implemented to include, but not limited to, solid-state, optical, and magnetic media whether volatile or non-volatile. Such examples include, semiconductor memory devices (e.g. Erasable Programmable Read-Only Memory (EPROM), Electrically Erasable Programmable Read-only Memory (EEPROM), and flash memory devices), magnetic discs such as internal hard drives and removable disks, magneto-optical disks, and CD-ROM (Compact Disc Read-Only Memory) and DVD (Digital Versatile Disc) disks.

The system 10 may include the service station 18 used to perform maintenance on the printhead 30 and air pressure regulation, such as to perform a hyper-inflation event to transfer fluid from a fluid container 40 to the FAA 20 and to maintain a back-pressure during normal operation within each of the fluid cartridges 40 and FAA 20. Such maintenance may include cleaning, priming, setting back pressure levels, and reading fluid levels. The service station 18 may include a pump 19 to provide air pressure to move fluid from the fluid containers 40 to the printhead 30 and to set a backpressure within the FAA 20 to prevent inadvertent leaking of fluid from the printhead 30.

Figure 1B:
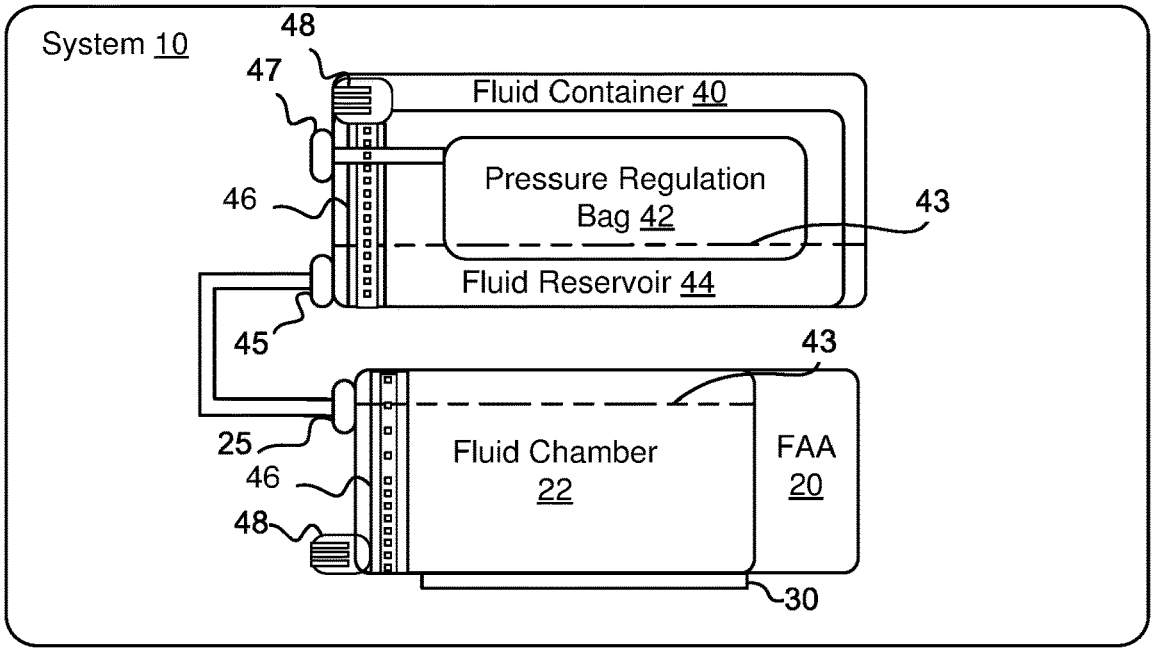
FIG. 1B is an alternative block diagram of the example fluid-based system of FIG. 1A.

FIG. 1B is an alternative block diagram of system 10 illustrating the operation of a fluid container 40 and FAA 20. The fluid container 40 includes a fluid reservoir 44 with a fluid level 43 that is coupled to a fluid chamber 22 via a container fluid interface 45 with a fluid tube to a FAA fluid interface 25. The fluid chamber 22 is further fluidically coupled to a printhead 30. To move fluid from the fluid container 40 to the FAA 20 having a separate fluid level 43, a pressure regulator bag 42 may be inflated within the fluid reservoir 44 via an air interface 47 that is coupled to pump 19. To monitor and measure fluid level 43 in either the fluid container 40 or the FAA 20 or both, a fluid property sensor 46 may be located within the fluid reservoir 44 and/or fluid chamber 22. The controller 100 may be electrically coupled to an electrical interface 48 on the fluid property sensor 46. The fluid property sensor 46 may be oriented substantially perpendicular to the fluid level 43 or it may be angled relative to the fluid level 43 but generally will extend from a gravitational bottom of the fluid container 40 or fluid chamber 22 to near a full fluid level 43 for the respective fluid container or chamber. The electrical interface 48 may be positioned near the full fluid level 43 as shown for fluid container 40 or near the gravitational bottom of fluid chamber 22. The fluid property sensor 46 may have an array of level sensors distributed substantially uniform as shown for fluid container 40 or non-uniform with a higher density of level sensors nearer the gravitational bottom as shown for fluid chamber 22. In addition to level sensors, a fluid property sensor 46 may include additional sensors such as temperature sensors, crack sensors, to just name a few.

Figure 2A:
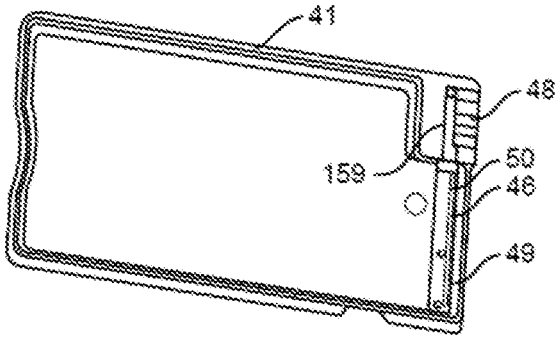
FIG. 2A is an illustration of an example sidewall with an attached example fluid property sensor.
Figure 2B:
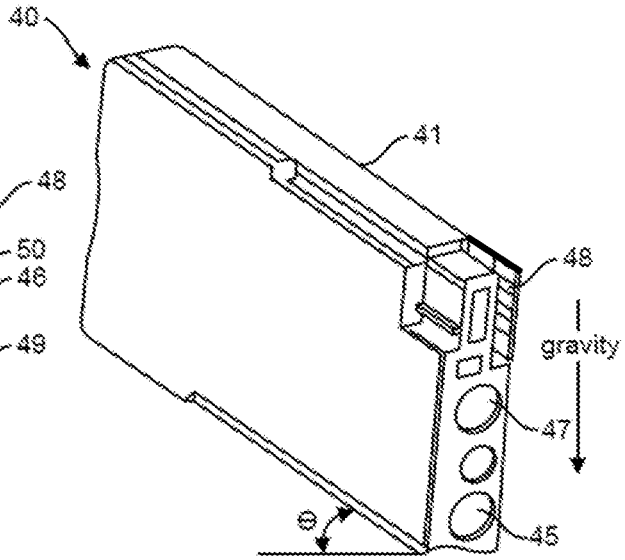
FIG. 2B is an illustration of a fluid container with the example sidewall and example fluid property sensor of FIG. 2A.

FIG. 2A is an illustration of an example sidewall 41 of an example fluid container 40 shown in FIG. 2B to demonstrate placement of fluid property sensor 46. Fluid property sensor 46 has an elongated circuit (EC) 49 with multiple sensors encased within a packaged encasement 50, such as with overmolding with a compound. The packaged encasement 50 may have openings to heat stake or otherwise attach the fluid property sensor 46 to the sidewall 41. The attachment of fluid property sensor 46 to sidewall 41 in one example is sufficient to allow the fluid property sensor 46 to conform to flexing of sidewall 41. As shown in FIG. 2B, sidewall 41 forms one exterior wall of the package of fluid container 40 which has air interface 47, electrical interface 48, and container fluid interface 45. As illustrated, the fluid container 40 in FIG. 2B may be angled slightly by an angle θ, such as about 3 to about 30 degrees, to allow fluid within the fluid container 40 to flow to the container fluid interface 45 and the bottom of fluid property sensor 46 to minimize wasted fluid when fluid container 40 is near empty. This angling of the fluid container 40 allows the fluid property sensor 46 to remain in contact with the fluid to provide accurate fluid levels.

The packaged encasement 50 allows for improved silicon die separation ratio, eliminate silicon slotting costs, eliminate fan-out chiclets, forming a fluid contact slot for multiple slivers simultaneously, and avoid many process integration problems. An overmolding technology can be used to fully or partially encapsulate the fluid property sensor 46 to protect an electrical circuit assembly (ECA) 159 and bond wire interconnects, while only exposing the multiple level sensors to the fluid within a container. In some examples, the fluid may be harsh, such as with low and high pH or reactive components. By having the integrated packaging, the ECA 159, bond wires, any driver circuits 204, memory, ASIC, or other ICs, and EC's 49 may all embedded in the packaged material (except for the sensor area) thereby increasing reliability. The ECA 159 includes thin strips of a conducting material, such as copper or aluminum, which have been etched from a layer, placed, laser direct sintered, or fixed to a flat insulating sheet, such as an epoxy, plastic, ceramic, or Mylar substrate, and to which integrated circuits and other components are attached. In some examples, the traces may be buried within the substrate of the ECA 159. Bond wires may be encased in epoxy or glue as just a couple of examples.

Figure 3:
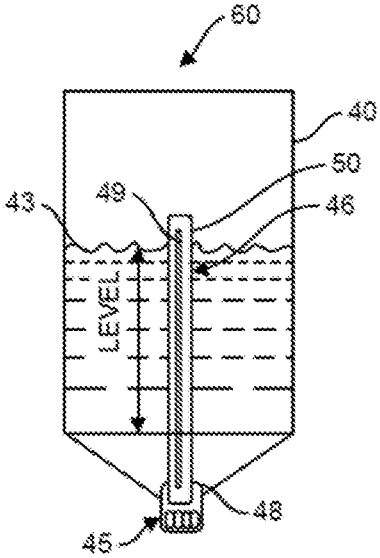
FIG. 3 is an illustration of another shape of an example fluid container.

FIG. 3 is an illustration 60 of another shape of an example fluid container 40 in which a fluid property sensor 46 is not attached to a sidewall of the fluid container 40 but rather is suspended within the fluid. EC 49 is surrounded by packaged encasement 50 except for an opening for a sensor portion having an array of sensors. The full fluid level 43 extends from the top of the EC 49 to a gravitational bottom of the fluid container 40 where there is the electrical interface 48 and a container fluid interface 45. In this example, the fluid container 40 has a non-uniform cross-section as the container walls taper to the fluid interface 45. The fluid property sensor 46 may have a non-linear or non-uniform distribution of point sensors 80 to adapt the fluid level readings to the changing cross-sectional shape of the fluid container. That is, the fluid property sensor 46 may have a less dense set of point sensors 80 near the full fluid level 43 and a denser set of point sensors 80 where the fluid container 40 tapers to the fluid interface 45.

Figure 4:
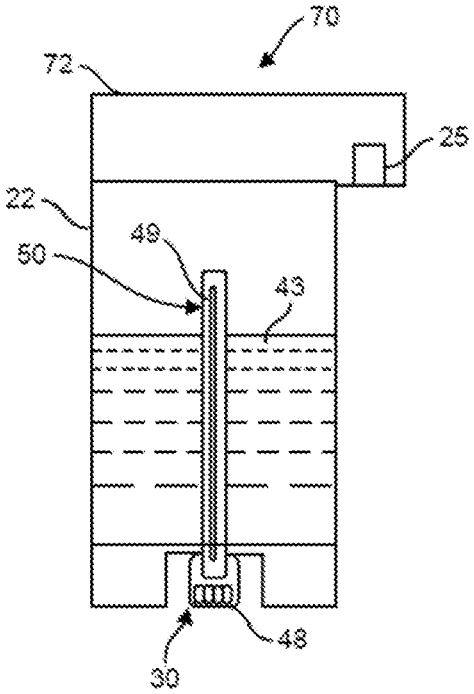
FIG. 4 is an illustration of another shape of a fluid actuation assembly.

FIG. 4 is an illustration 70 of another shape of a FAA 20. The FAA 20 has a top portion 72 having an FAA fluid interface 25 that may be coupled to the container fluid interface 45 of FIG. 3 to deliver fluid to the fluid chamber 22. A fluid property sensor 46 extends from a proximal end at a gravitational bottom of the FAA 20 into the fluid up to a distal end at a full fluid level 43. As with the fluid container 40 of FIG. 3, the electrical interface is located near the gravitational bottom, and one or more printhead dies 30. As fluid is withdrawn based on use, the FAA fluid interface 45 may be used to refill the fluid chamber 22, to adjust backpressure, and prevent the printhead dies 30 from being damaged due to no fluid. Therefore, it may be desirable to increase the density of the point sensors 80 near the gravitational bottom of the FAA 20 to detect when the printhead dies 30 may be starved of fluid, particularly during long print jobs.

Accordingly, a fluid container 40 or FAA 20 (collectively referred to as fluid container 40) may include a package containing a fluid chamber 22 or fluid reservoir 44 for containing a fluid. A fluid property sensor 46 may include a sensing portion extending into the fluid chamber 22 or fluid reservoir 44 and may include multiple integrated circuits (ICs) that share a common interface bus 83. At least one elongated circuit (EC) 49 may have multiple exposed sets of multiple sensors distributed along a length of the EC 49. An interface portion may be exposed outside the package and include an electrical interface 48 electrically coupled to a proximal end of the sensing portion. The multiple ICs and the electrical interface 48 are packaged together to form the fluid property sensor 46. The sets of multiple exposed sets of multiple sensors may be distributed non-linearly or non-uniformly along the length of the EC 49 and have a layout with an increasing density along a portion of the EC 49 near a gravitational bottom of the fluid container 40 or FAA 20 when in use. The density of point sensors 80 may be between 20 and 100 per inch and in some instances at least 50 per inch. In other examples, the density of point sensors 80 may more than 40 sensors per centimeter in a higher density region and less than 10 sensors per centimeter in lower density regions. The sensing portion may include at least one additional sensor 85, 86 to allow for one of a property sense of the fluid and a temperature sense of the fluid. The EC 49 may have a thickness between about 10 um and about 200 um, a width between 80 um and 600 um wide, and a length between about 0.5 in. to about 3 in. The aspect ratio of width:length of an EC 49 die may be at least 1:50, meaning 50 times longer than wide. In some examples, the width: length ratio may exceed 100 or over two orders of magnitude in length than width. In contrast, the driver circuit 204 may be an IC with an aspect ratio less than 1:10. Accordingly, the fluid sensor may include an EC 49 with an aspect ratio that is five or even ten times greater than the aspect ratio of the driver circuit 204.

FIGS. 5A-5D are illustrations of just some different example implementations of the fluid property sensor 46. For ease of discussion, top and bottom directional descriptors are used to help identify components. The top and bottom references are in relation to how the fluid property sensors 46 are to be used in a fluid container with respect to gravity. The terms top and bottom are not meant to be limiting. Also, the terms proximal, distal, and mesial are used to also describe components with respect to their position to the electrical interface 48 and thus are independent of gravitational influences.

Figures 5A, 5B, 5C, 5D:
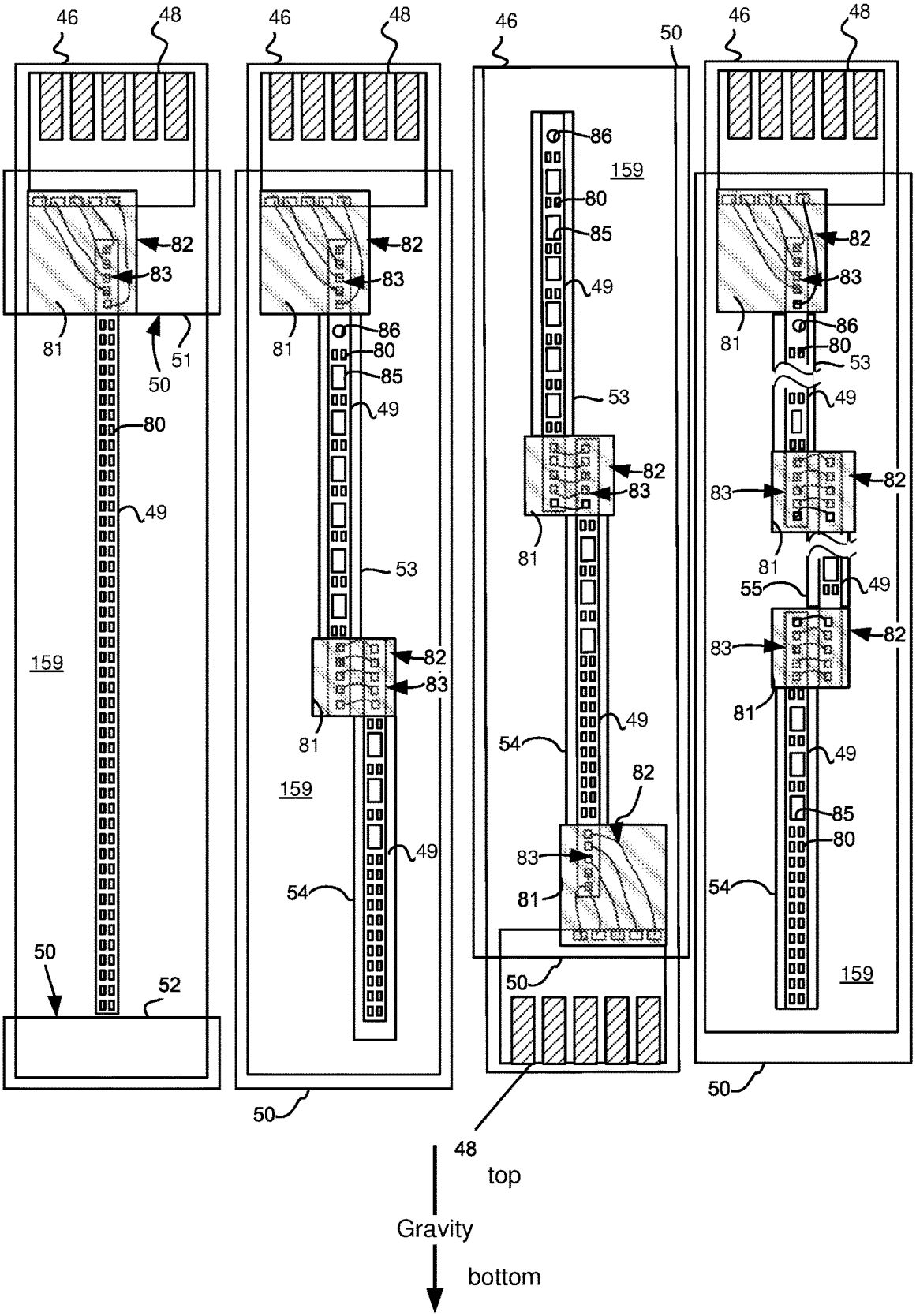
FIGS. 5A-5D are illustrations of different example implementations of a fluid property sensor.

FIG. 5A is an example of a fluid property sensor 46 having a single EC 49 that is electrically coupled to electrical interface 48 proximal to a top (relative to gravity) of fluid property sensor 46 with a set of bond wires and encapsulated with an epoxy or glue coating 81 to protect the bond wires 82 when the packaging of encasement 50 takes place. In this example, the electrical interface 48 shown has five contacts (VCC, GND, Data, Clock, and Sense signals) that form a common interface bus 83 but may have more or less depending on the application. The Sense signal may be used to provide digital or analog signals and may also be used for test, security, or other purposes. The Data and Clock signals are typically digital signals where the data line is a bidirectional line, and the Clock signal is typically an input into an EC 49 or other ICs, such as a driver circuit 204.

The packaged encasement 50 in this example includes a first packaged section 51 and a second packaged section 52 on opposite ends of the ECA 159 of the fluid property sensor 46. The first packaged section 51 protects the encapsulated wire bonds 82. The second packaged section 52 of packaged encasement 50 provides for support from twisting and support for mounting. The two separated packaged sections 51, 52 of packaged encasement 50 allow for improved thermal expansion differences between the EC 49, the ECA 159, and the packaged encasement 50.

FIG. 5B is an example of a fluid property sensor 46 having two different types of EC 49 that are staggered and daisy-chained on ECA 159 to form a longer fluid property sensor 46. The top EC 49 is electrically coupled to the electrical interface 48 proximal to the top of the fluid property sensor 46. The top EC 49 in this example has multiple sensors, such as point sensors 80 and temperature sensor 86. The bottom distal end of the top EC 49 has a set of bond pads that are coupled within the top EC 49 to the common interface bus 83 on the top distal end of the top EC 49 and thus allow pass-through of the common interface bus 83. The bottom bond pads of the top EC 49 are coupled with bond wires 82 to a top set of bond pads on the bottom EC 49 to provide the common interface bus 83 to the bottom EC 49. The bottom EC 49 in this example includes a uniform set of point sensors 80. They are distributed at a higher density than the point sensors 80 of the top EC 49 to allow for better resolution near the gravitational bottom of a fluid container.

In this example, the packaged encasement 50 spans the entire length of the fluid property sensor 46 less the external electrical interface 48 and includes a first opening 53 on the top or proximal EC 49 and a second opening 54 on the bottom or distal EC 49.

FIG. 5C is an example where the electrical interface 48 is proximate to the gravitational bottom of the fluid sensor. The top distal end of the fluid property sensor 46 has a top EC 49 like the top EC 49 of FIG. 5B but in this example without the top distal set of bond pads. A bottom set of bond pads allow for bond wires 82 to couple the top set of bond pads of the common interface bus 83 on the bottom EC 49. The bottom end of bottom EC 49 includes a second set of bond pads to couple the common interface bus 83 to the electrical interface 48. The bond pads and bond wires 82 may be encapsulated with an epoxy or glue to prevent damage to the bond wires during a latter packaging of the fluid property sensor 46. Like FIG. 5B, the bottom EC 49 has a denser set of point sensors 80 than the top EC 49. The top EC 49 may have additional sensors such as temperature sensor 86.

Like the example in FIG. 5B, in this example, the packaged encasement 50 spans the entire length of the fluid property sensor 46 less the external electrical interface 48 and includes a first opening 53 on the top or distal EC 49 and a second opening 54 on the bottom or proximal EC 49.

FIG. 5D is an example where there are at least three ECs 49, which may be of the same or different configurations. In this example, the top EC 49 is bonded to the electrical interface 48 and is configured similarly to the top EC 49 of FIG. 5B. A middle or mesial EC 49 is electrically coupled to both the top EC 49 and a bottom EC 49. The middle EC 49 can be just a very low-cost EC 49 with pass-through of the common interface bus 83, or it may include the pass-through along with a minimal set of point sensors 80. In other examples, it may be of the same configuration as the top EC 49. The bottom EC 49 may be an EC with a non-uniform distribution of point sensors 80 with a higher density on the bottom distal end for increased resolution during low-on-ink (LOI) or other low fluid levels. Accordingly, the sets of multiple point sensors 80 may be distributed non-linearly along the length of an EC 49 or the fluid property sensor 46 and have a layout with an increasing density along a portion of the EC 49 or the fluid property sensor 46 near a gravitational bottom of the fluid container 40 or FAA 20 when in use.

The packaged encasement 50 includes a first opening 53 on the top or proximal EC 49, a second opening 54 on the bottom or distal EC 49, and an additional third opening 55 in the middle or mesial EC 49.

Accordingly, a fluid property sensor 46 may include an elongated circuit (EC) 49 having multiple exposed sets of multiple point sensors 80 distributed along a length of the EC 49. An external electrical interface 48 may be coupled to a proximal end of the EC 49, wherein the EC 49 and the external electrical interface 48 are packaged together to form the fluid property sensor 46. Multiple ECs 49 may be daisy-chained end to end along a direction of the length of the fluid property sensor 46 and share a common interface bus 83. In some examples, a second elongated circuit 49 (second EC) may be further packaged together and extending in the direction of the length of the fluid property sensor 46 from a distal end of the EC 49 and electrically coupled from the distal end of the EC 49 to a proximal end of the second EC 49. In other examples, the multiple ECs 49 may include a mesial EC 49 between the proximal EC 49 and the distal EC 49, the mesial EC 49 having a minimal set of point sensors 80 and a pass-through of the common interface bus 83. The multiple ECs 49 may include a proximal EC 49 with a set of various types of sensors and a distal EC 49 with a high density of sets of point sensors 80 of at least 50 per inch. In some examples, the sets of multiple point sensors 80 are distributed non-linearly along the length of the EC 49, and in other examples, the sets of multiple point sensors 80 are distributed non-linearly along the length of the fluid property sensor 46.

Figure 6:
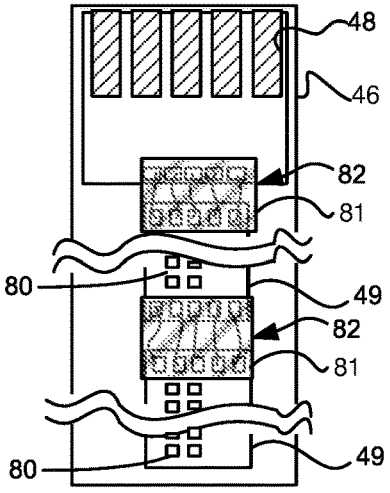
FIG. 6 is an example of a slightly wider elongated circuit (EC) dies to accommodate more bond pads.

FIG. 6 is an example of a slightly wider EC 49 to accommodate the five bond pads for the common interface bus 83 in a single horizontal (vs. vertical in previous examples) direction. This arrangement of the layout of the bond pads allows for more silicon area to allow for integration of more digital and analog circuitry within the EC 49 as well as providing more structural support during flexing to prevent the die from cracking. Also, the ECs 49 may be aligned in a straight column rather than staggered. The multiple ECs 49 may include a proximal EC 49 with a set of various types of sensors and a distal EC 49 with a high density of sets of multiple point sensors 80 of at least 40 point sensors per centimeter.

Figure 7:
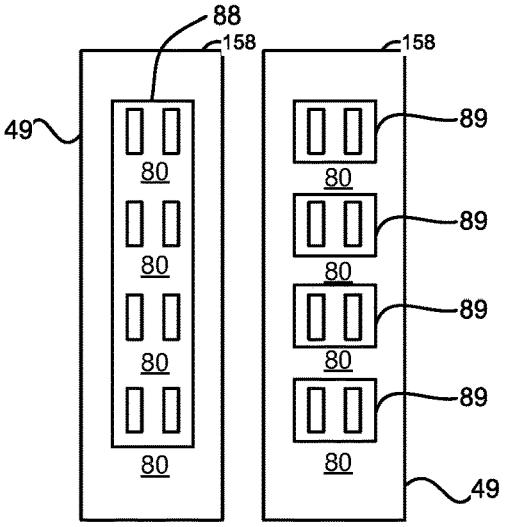
FIG. 7 is an example of the openings in a protective layer to expose sensors on the EC dies.

FIG. 7 is an example of the openings in a protective layer such as an oxide, nitride, or another passivation layer (such as TEOS layers 158, FIGS. 10 and 11) to expose electrical impedance sensors (FIG. 9B) on the EC 49 dies. Depending on the type of sensor, it may be better to have a single opening 88. In other examples, to provide additional protection of the EC dies from harsh fluids, it may be better to have the sensors have a limited or per sensor single opening 89.

Figure 8:
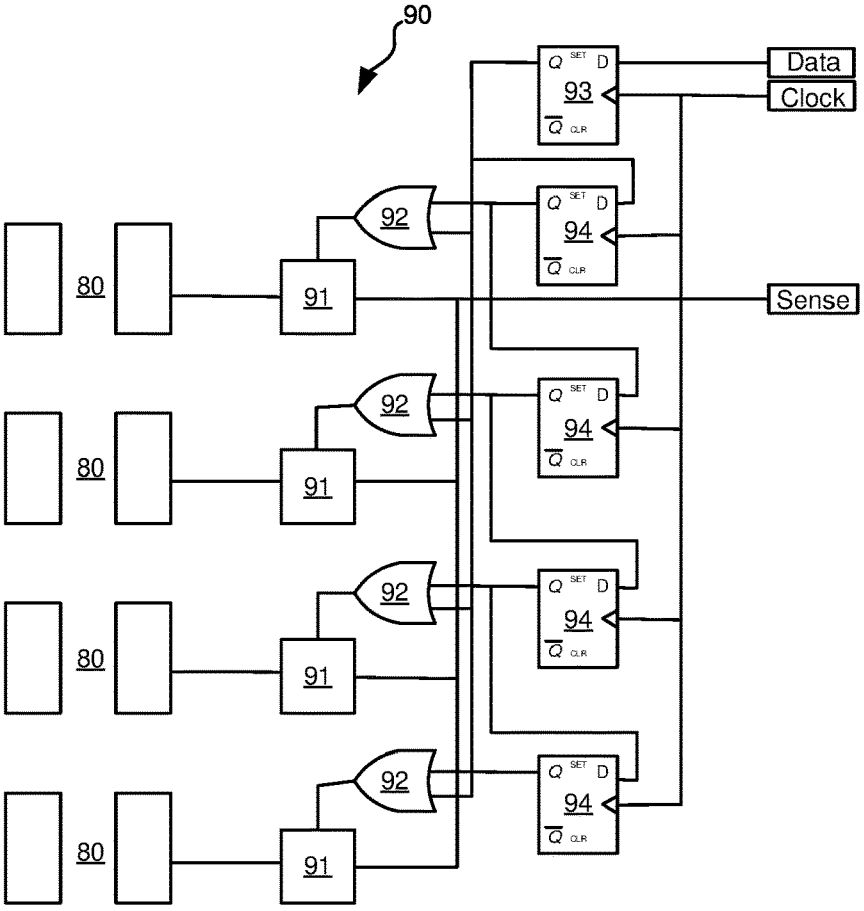
FIG. 8 is a schematic diagram of an example circuit to allow point sensors to be individually strobed for impulse measurements or collectively read together for a parallel measurement.

FIG. 8 is a schematic diagram 90 of an example circuit of how to allow point sensors 80 to be individually strobed for impulse measurements or collectively read together for a parallel measurement. For some analysis of the fluid, a single fluid sensor 80 may be used, such as to detect the level of the fluid. In other analysis, an increased surface area may be required to get a good characterization of the fluid, such as determining chemical composition. Further, as the fluid level may be changing, it may be desirable to not gang together point sensors 80 that are in contact with air rather than the fluid. Parallel register 93, which can be a latch, flip-flop, or another memory cell, receives a data signal which is entered into the parallel register 93 with a clock signal. The clock signal and data signal are derived from the common bus interface as is the Sense signal which may be analog or digital depending on the implementation. The Q output of the parallel register 93 is coupled to a set of OR gates 92. If set high, parallel register 93 enables switches 91 from each of the point sensors 80 to close and couple the point sensors 80 to the Sense signal for a parallel measurement. The parallel register 93 Q output is also coupled to the D input of impulse registers 94 which have their Q outputs coupled to the next impulse register 94 to allow for a firing signal to be shifted down the chain of impulse registers 94 for each clock cycle to allow each fluid sensor 80 to be coupled individually to the sense line to allow for impulse measurements via internal strobe firing. Accordingly, multiple point sensors 80 may be configured to allow for at least one of parallel measurement and internal strobe firing for impulse measurements. A single Data signal can be clocked first into parallel register 93 to provide a parallel measurement and then on successive Clock signals transferred down the impulse registers 94 to provide for internal strobe firing for impulse measurements from each fluid property sensor. Point sensors 80 may be of several different types of point sensors 80, such as fluid chemical property sensors, temperature impedance sensors, electrical impedance sensors, and the like. Depending on the data entered and clocked into the parallel register 93 and impulse registers 93, each of the various sensors may be individually read and measured or combined with other similar sensors for a parallel measurement.

Figure 9A:
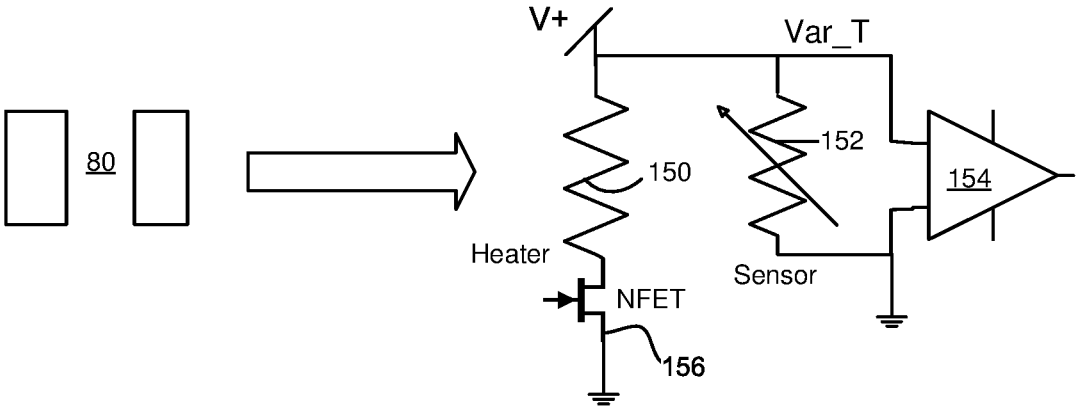
FIG. 9A is an example of a temperature impedance based fluid sensor.

FIG. 9A is an example of a temperature impedance based fluid sensor 80. In this example, a heater 150, formed of a resistive or semiconductor element is powered and controlled by a V+ voltage using a NFET 156. In other examples, a PFET coupled between the V+ and the heater 150 may be used to power and control the heater. A thermally sensitive piezo-resistive element 152 is used to detect the heat transmitted by the heater 150. If there is fluid in contact with the fluid sensor 80 then heat from the heater 80 will be dissipated into the fluid at a faster rate than when the fluid sensor 80 is in contact with air inside a fluid container. Accordingly, the amount of heat absorbed by the piezo-resistive element 152 will be different for fluid versus air interaction at fluid sensor 80. Read circuitry 154 may include amplifiers analog/digital converters, offset compensation, etc. and may be used to amplify and convert the change in the resistance of piezo-resistor 152 to a more usable signal. Also, the time in which the heat from heater 150 dissipates into the fluid and detected by piezo-resistor 152 will vary depending on the composition of the fluid. For instance, a fluid with dye will typically have less mass than a fluid with particulates such as pigments. Different solvents within the fluid will have varying degrees of heat absorption. Some fluids may separate over time, and boundary layers may be created. Also, particulate fluids such as pigment-based ink may have different densities at different gravitational heights due to settling. Therefore, by examining the output of the read circuitry 154 over time from the initiation of the heater 150 and performing a Fourier or other time to frequency transformation, different types of ink may be characterized by their FFT (or another transform) signature. In one example, the point sensors 80 may each have their heaters 150 pulsed in parallel, and the thermally sensitive piezo-resistive elements read individually to allow for a quick search of the fluid level 43. Those point sensors 80 in contact with air will have a higher temperature than those in contact with the fluid.

Figure 9B:
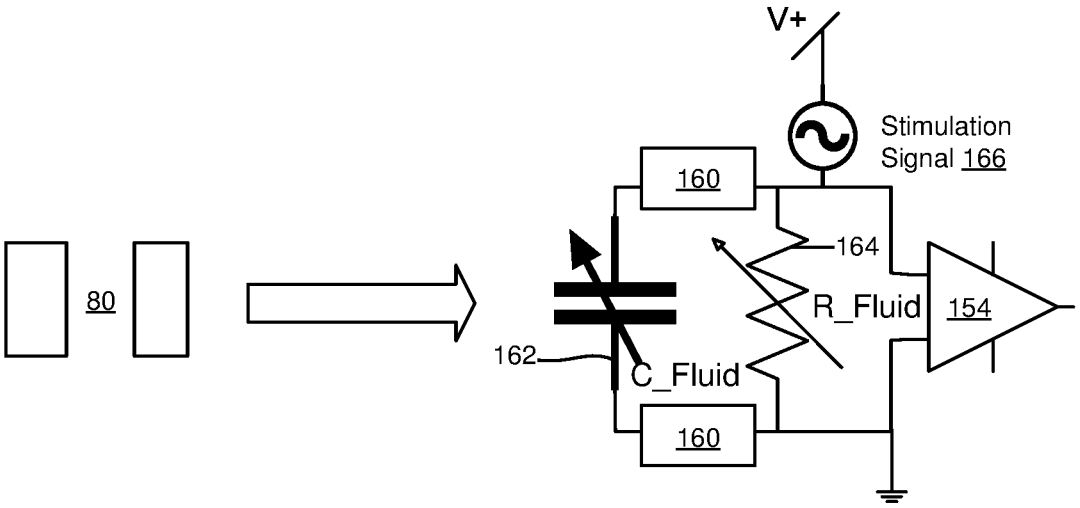
FIG. 9B is an example of an electrical impedance based fluid sensor.

FIG. 9B is an example of an electrical impedance based fluid sensor 80 that may be used separately or in combination with the example in FIG. 9A. In this example, a voltage or current (either AC, DC, or both) stimulation signal 166 is applied to a set of twin metal pads 160 of fluid sensor 80, and the response to the stimulation signal is read by reading circuitry 154. Based on the ionic chemistry (pH, resistance, etc.) of the fluid makeup in a fluid container 40, the fluid will generally have a capacitance C-Fluid and resistance (R-Fluid) thereby causing a change between the stimulation signal and the measured response from the read circuitry 154. Some fluid characteristics such as pH may be determined by the conductance of the fluid, but different fluid compositions may have different conductance at the same pH level. Therefore, it may be advantageous also to apply a varying AC signal and determine the appropriate response at each frequency and perform an FFT or another time-frequency conversion to retrieve a frequency signature that can be used to look up the particularly known fluids that have been characterized. Based on the type of fluid identified, the pH reading may be adjusted to compensate or calibrate for other ionic chemicals. Further, a temperature sensor 86 can be used to provide temperature compensation for the pH reading.

Figure 9C:
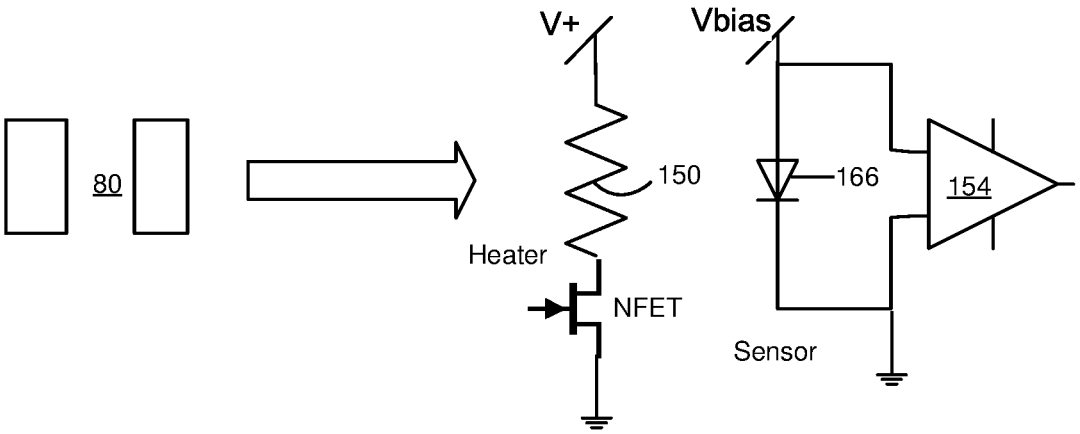
FIG. 9C is another example of a temperature impedance based fluid sensor.

FIG. 9C is another example of a temperature impedance based fluid sensor. In this example, the piezo-resistive element 152 of FIG. 9A is replaced with a diode 166 that is biased with a voltage bias source (Vbias). The forward voltage across the diode 166 will change based on the temperature sensed due to changes in doped ion conductivity. Characterization of the fluid level may be done by checking the voltage across the diode 166 after a set time from heater activation. When fluid is in contact with the fluid sensor 80, there will be a lower temperature change than when the air is in contact with the fluid sensor 80.

Figure 10:
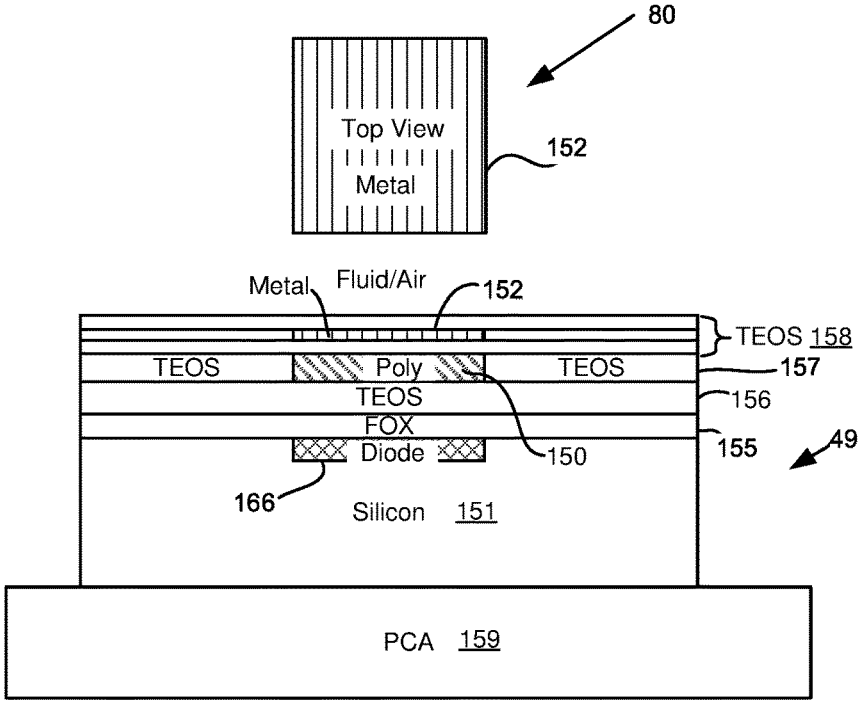
FIG. 10 is an example cross-section of an EC of possible point sensors.

FIG. 10 is an example cross-section of an EC 49 of possible point sensors 80. In this example, an electrical circuit assembly (ECA) 159 supports a silicon-based elongated circuit (EC 49) having the fluid sensor 80. The silicon base layer 151 may be CMOS, PMOS, NMOS, or other types of know semiconductor surfaces. This silicon base layer 151 may include transistors, diodes, and other semiconductor components. In some examples, a temperature sensing diode 166 may be incorporated into the silicon base layer 151. To improve thermal sensitivity, the silicon base layer 151 may be planarized and thinned to allow for less silicon mass to absorb thermal energy from a heater resistor 150, formed in a polysilicon layer separated from the thermal diode 166 by a field oxide (FOX) layer 155 and a tetraethyl orthosilicate (TEOS) oxide layer 156. To isolate the heater resistor 150 from surrounding components, it may be surrounded by an additional TEOS layer 157. To protect the heater resistor 150 from the harsh chemicals of a fluid in a container, there may be one or more additional TEOS layers 158 between the heater resistor 150 and the fluid or air of the fluid container.

In some situations, it is preferable to have a thicker silicon base layer 151 to provide more structural strength, such as the example in FIG. 5A, where there are two separated packaged portions and the EC 49, is suspended between them. To improve the amount of temperature difference detected between air and fluid and to prevent having to thin the silicon base layer 151 and thus provide additional strength for the EC 49 die, a piezo-resistive metal temperature sensor 152 may be formed in a metal layer close to the fluidic interface. The metal layer may be doped with various impurities, such as boron, to provide the desired piezo-resistive effect. In this example, there is no temperature sensing diode 166 in the silicon and the poly heater resistor 150 is used to heat the piezo-resistive metal temperature sensor 152. Since the heater resistor 150 is close to the metal temperature sensor 152, it will heat up quickly. If there is fluid adjacent to the metal temperature sensor 152, it will cool after heat is removed at a much faster rate than if air is adjacent to it. The rate of change of temperature may be used to determine whether fluid is present or not. In other examples, sampling the resistance of the metal temperature sensor 152 at a fixed time after power to the heater resistor 150 has been terminated, a comparison to a predetermined threshold can be used to determine if the fluid is present or not.

In one example, the silicon base layer 151 may be about 100 um (micrometers) thick and the temperature diode 166, if present, about 1 um in depth. A thinner silicon base layer 151 such as to about 20 um allows for a higher differential temperature change between air and fluid interfaces. For example, a 20 um silicon base layer 151 may have more than 14 deg. C. change in the temperature differential between air and fluid, while a 100 um silicon base layer 151 may have about a 6 deg. C. temperature differential. A thinner die may also cause the maximum temperature at the fluid/air interface to increase as the die becomes thinner due to less mass of the die to absorb the thermal energy. The FOX layer 155 may be about 1 um in depth, the first TEOS layer 156 about 2 um in depth, and second TEOS layer with the polysilicon about 2 um in depth as well. If no metal temperature sensor 152 is used, the additional TEOS layers 158 may be about 2 um. If the metal temperature sensor 152 is used, it may be positioned about 1 um from the polysilicon heater resistor 150 and be about 1 um in thickness and topped with an additional TEOS layer of about 1 um in thickness.

Depending on the various compositions of the fluids used in a system with multiple fluid containers, it may be desirable to have the maximum temperature at the fluid/air interface remain substantially constant relative to the amount of energy applied to the heater resistor 150 as well as keeping the differential temperature for the fluid/air interface also substantially constant. This may allow for more consistent readings and less calibration.

Figure 11:
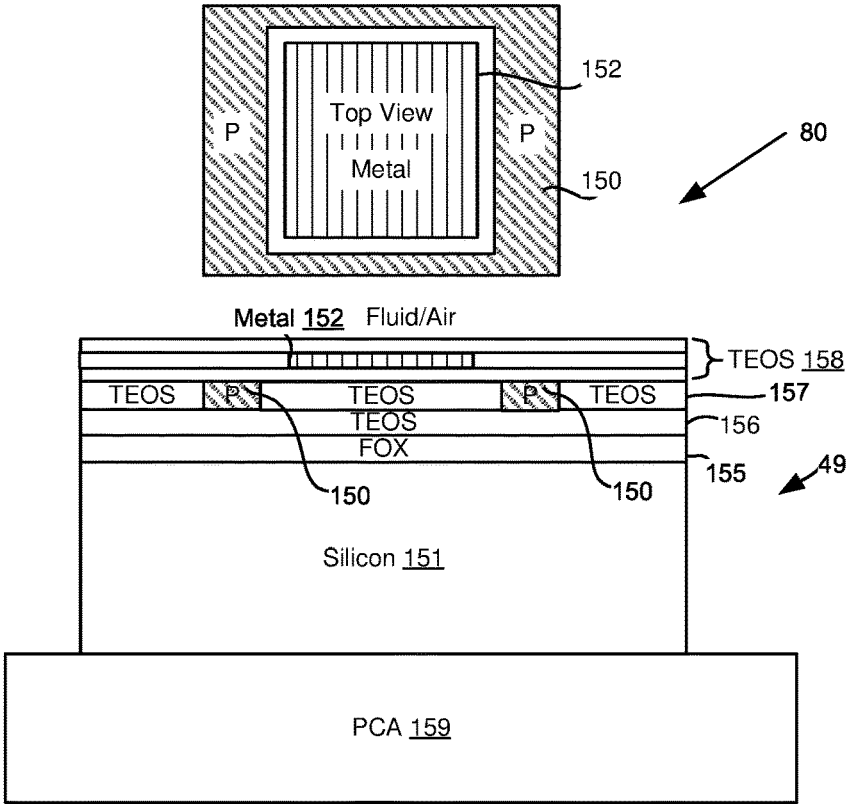
FIG. 11 is an example cross-section of a piezo-resistive metal temperature sensor that is surrounded by a polysilicon heater resistor.

FIG. 11 is another example of a piezo-resistive metal temperature sensor 152 that is surrounded by a poly-silicon heater resistor 150. In this example of a ring heater, the heat from the poly-silicon heater resistor 150 is more easily transferred to the fluid and only indirectly heats the metal temperature sensor 152. In this configuration, the temperature differential between a fluid and an air interface can be held relatively constant at about 8 deg. C. in one example. While the max temperature at the fluid/air interface may be slightly higher than the example in FIG. 10, the increased thermal conductivity from the heater resistor to the fluid allows the fluid to keep the max temperature stable over a range of energy applied to the heater resistor 150. This example has similar dimensions as that described for FIG. 10. In another example, the temperature sensor 152 may form a ring around resistor 150, which may be a square or other shape.

Figure 12A:
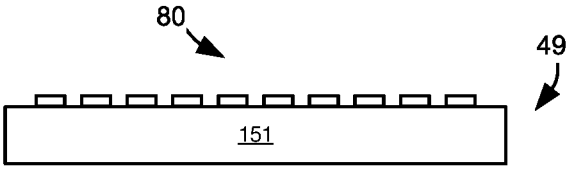
FIGS. 12A-12C are example preparatory stages for making a packaged fluid property sensor.
Figure 12B:
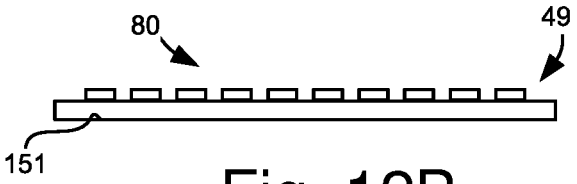
Figure 12C:
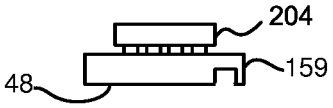

FIGS. 12A-12C are example preparatory stages for the example method 200 of FIGS. 13A-13E of a process to fabricate a packaged fluid property sensor 46. In FIG. 12A, an elongated circuit (EC) 49 has a silicon base layer 151 on which is formed a set of point sensors 80. In FIG. 12B the silicon base layer 151 is planarized to thin the silicon base layer to a range of about 200 um to 20 um when using a thermal fluid sensor with a diode-based temperature sensor. When using a metal-based temperature sensor or when more die strength is desired, the die thinning operation in FIG. 12B may not be performed. In FIG. 12C a driver circuit 204 may be mounted to an electrical circuit assembly (ECA) 159 which has an electrical interface 48 on an opposing side of the ECA 159 coupled to a common interface bus 83 bond site.

Figure 13A:
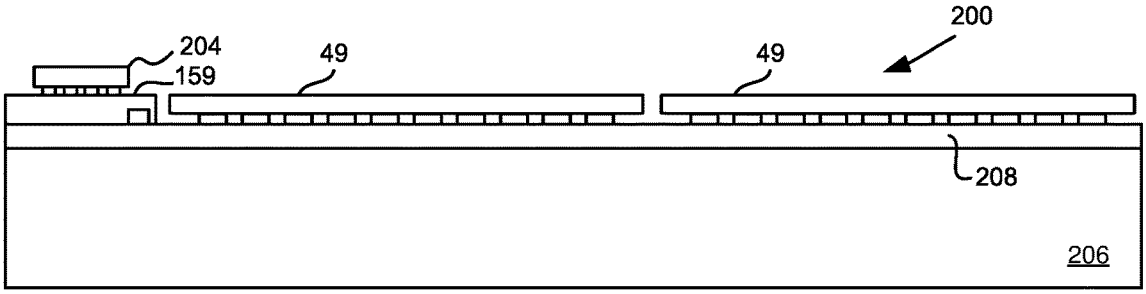
FIGS. 13A-13E are an example method of making a packaged fluid property sensor.
Figure 13B:
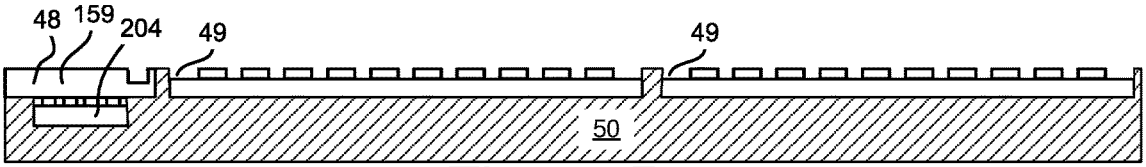

FIGS. 13A-13E are an example method 200 of making a packaged fluid property sensor. In FIG. 13A, the ECA 159 and one or more ECs 49 are placed on a tape 208 and a carrier or substrate 206 in a die/electrical circuit substrate attach operation. In FIG. 13B, the EC 49 die and ECA 159 may be transfer molded with a compound, such as an epoxy molded compound or a thermal plastic compound at a temperature of about 130 to about 150 deg. C. For this disclosure, a 'compound' is broadly defined herein as any material including at least thermosets of an epoxide functional group, polyurethanes, a polyester plastic, resins, etc. In one example, the compound may be a self cross-linking epoxy and cured through catalytic homopolymerization. In another example, the compound may be a polyepoxide that uses a co-reactant to cure the polyepoxide. Curing of the compound forms a thermosetting polymer with high mechanical properties, high-temperature resistance, and high chemical resistance.

Figure 13C:
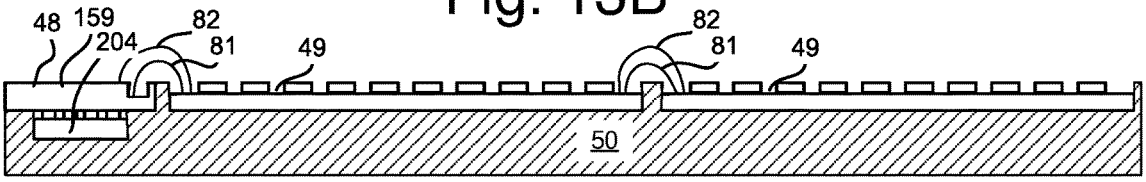
Figure 13D:
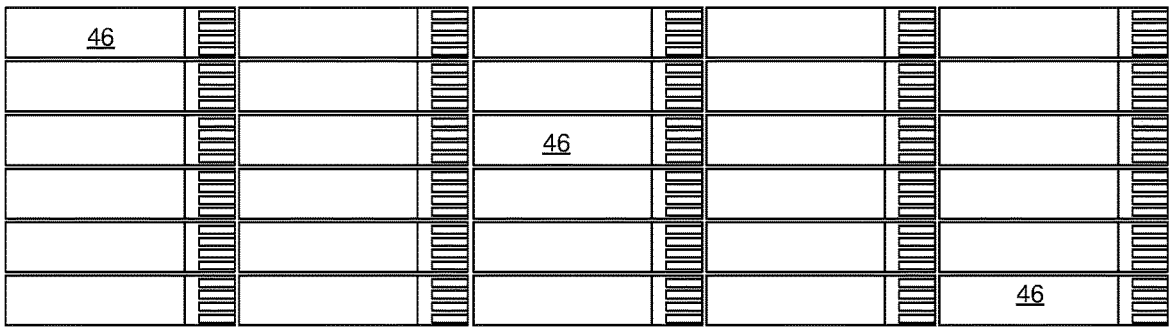
Figure 13E:
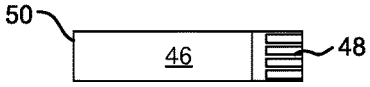

The carrier 206 and tape 204 are released, and the packaged assembly 50 is turned over as shown. In FIG. 13C, the ECA 159 common interface bus 83 is wire bonded to a proximal EC 49 at a proximal end of the EC 49 die. The distal end of the EC 49 die is wire bonded to a distal EC 49 die at its proximal end. The wire bonds 82 are then encapsulated with an epoxy or glue coating 81. FIG. 13D illustrates that the operations in FIGS. 13A-13C may be performed using a panel of an array of fluid property sensors 46. The panel may be of any size but in one example is about 300 mm by 100 mm allowing for an array of about a 6×6 array. In step 13E, an individual fluid property sensor 46 with packaged encasement 50 and electrical interface 48 is singulated from the array.

Accordingly, a method of making a fluid property sensor may include placing an electrical circuit assembly (ECA) 159 on a carrier substrate 206 and placing on the carrier substrate 206 an elongated circuit (EC) 49 having multiple exposed sets of multiple point sensors 80 distributed along a length of the EC 49. The method includes encapsulating using transfer molding the external interface board 159 and the EC 49 and removing the carrier substrate 206. The external interface board 159 is electrically coupled with the EC 49 to a common interface bus 83 with bond wires 82. The bond wires 82 of the electrical coupling are encapsulated with an epoxy or glue coating 81. In some examples, there are multiple ECs 49 arranged in a daisy chain pattern and share the common interface bus 83. The common interface bus 83 may be electrically coupled between respective distal and proximate ends of the multiple ECs 49 in the daisy chain pattern. In some examples, the EC 49 silicon base layer 151 may be thinned prior to placing on the carrier substrate 206. The fluid property sensor 46 may be formed on an ECA panel with multiple fluid property sensors 46 formed in an array and singulated from the array after encapsulating the electrical coupling with epoxy.

Figure 14A:
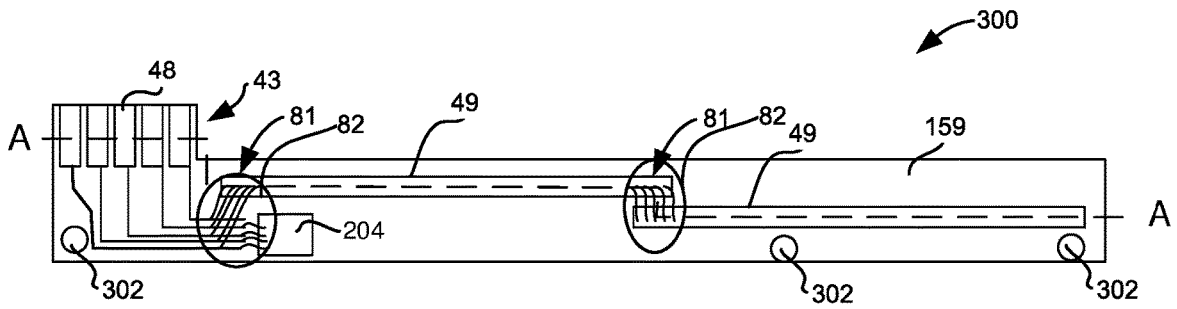
FIGS. 14A-14D are another example method of making a packaged fluid property sensor.
Figure 14B:
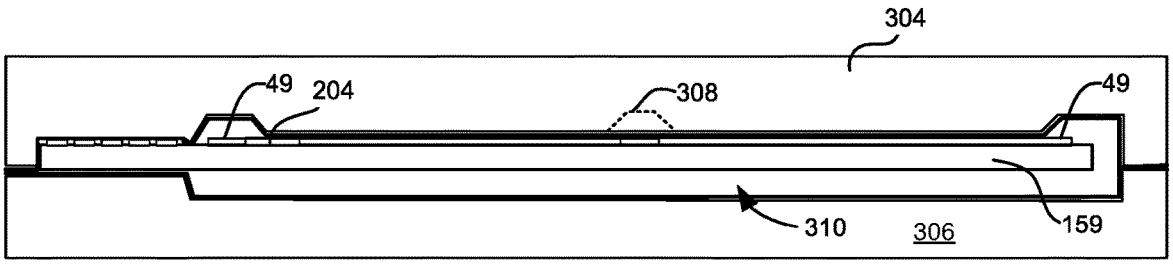
Figure 14C:
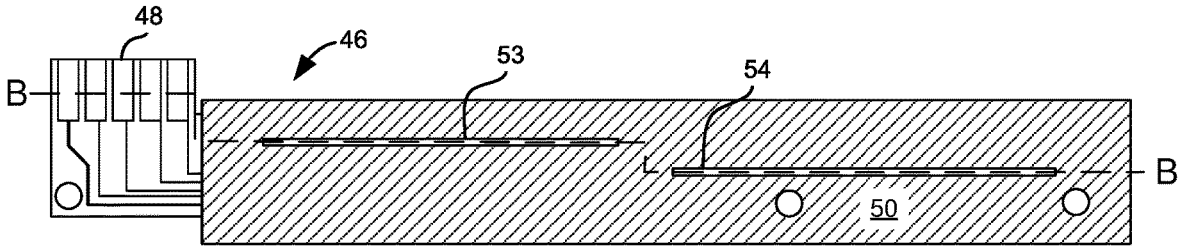
Figure 14D:
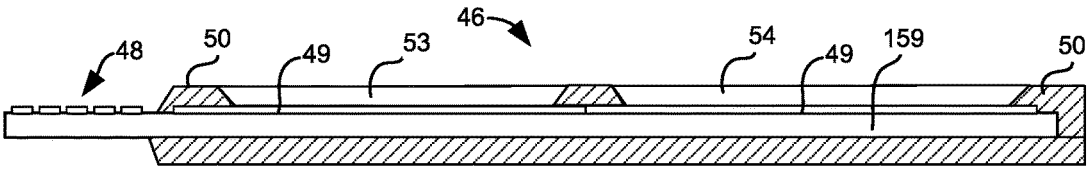

FIGS. 14A-14D are another example method of making a fluid property sensor 46. In FIG. 14A, one or more ECs 49 are placed on an ECA 159 having an external electrical interface 48 along with a driver circuit 204. The ECs 49 and the driver circuit 204 are wire bonded with bond wires 82 to the ECA 159 and encapsulated with an epoxy or glue coating 81. FIG. 14B is a cross-section along the A-A cut line of FIG. 14A for a transfer overmolding packaging operation. Transfer overmolding is a manufacturing process where casting material is forced into a mold to mold over other items within the mold, such as ECA 159, EC(s) 49, and driver circuit 204. In FIG. 14B, a top mold 304 is placed on the top surface of ECA 159, and a bottom mold 306 is placed upon the bottom surface of the ECA 159. The top mold 304 and the bottom mold 306 form a chamber 310 where the compound (compound) is to be injected in the transfer overmolding operation. The top mold 308 may have one or more indentations 308 to allow for the epoxy or glue coating 81 over the bond wires 82. A top surface and a bottom surface of the ECA 159 are packaged with a compound while exposing a sensing portion of the EC with no overmolding, such as openings 53 and 54 shown in the finished fluid property sensor 46 with packaged encasement 50 and external electrical interface 48. FIG. 14D is a crossectional side view of FIG. 14C along the B-B cut line. The ECA 159 is shown supporting the external electrical interface 48 and ECs 49 within the packaged encasement 50. Openings 53 and 54 allow the sensor area of the ECs 49 to have contact with fluid or air.

Figure 15A:
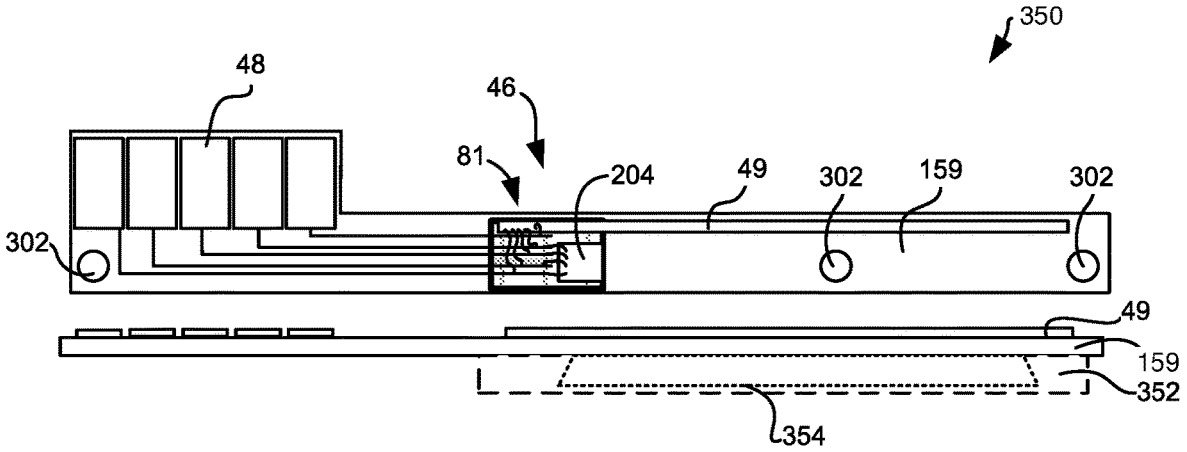
FIGS. 15A-15D are illustrations of another example process of making a packaged fluid property sensor.

FIGS. 15A-15D are illustrations of another example process 350 to make a fluid property sensor 46. FIG. 15A shows a top and side view of an ECA 159 having an external electrical interface 48, an EC 49 mounted onto and wire bonded to traces with bond wires 82 on the ECA 159, a driver circuit 204 also mounted onto and wire bonded to traces on the ECA 159. The wire bonds may be encapsulated with epoxy for protection during the transfer overmolding. The ECA 159 may include a set of mounting holes 302 to allow mounting the finished fluid property sensor 46 to a fluid container. In some examples, the ECA 159 may be a flex circuit and in other examples may be a glass, polymer, ceramic, paper, or FR4 glass epoxy electrical circuit substrate with copper, with solder, tin, nickel or gold plating, or other conductive traces, single or double-sided. As shown in the side view, in some examples, a support structure 352 may be placed under the ECA 159 to provide structural strength during transfer overmolding to prevent the EC 49 from being over stressed. In another example, a removable support 354 may be used in place of support structure 352. To allow for removal, a release liner 356 may be placed between the removable support 354 and the ECA 159. Release liners 356 may also be applied to the top mold 304 and the bottom mold 306 to facilitate removal of the fluid property sensor 46 from the mold. In another example, the bottom mold 306 may include a support topography on the bottom mold 306 and the top mold 304 may include a chase to extend down and seal off the sensing portion of the EC 49 during overmolding.

Figure 15B:
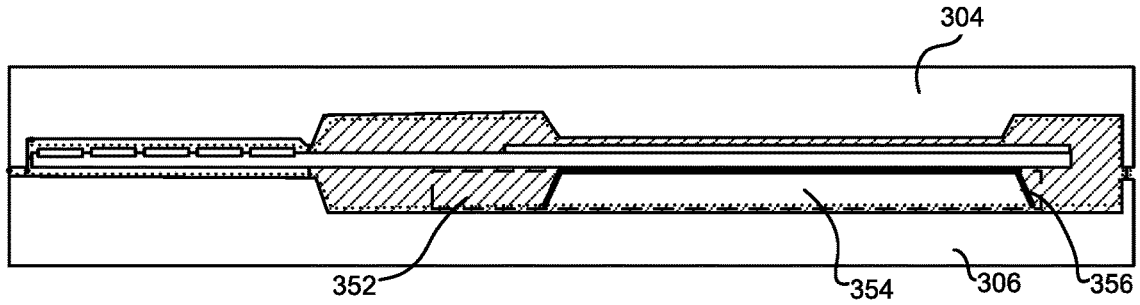
Figure 15C:
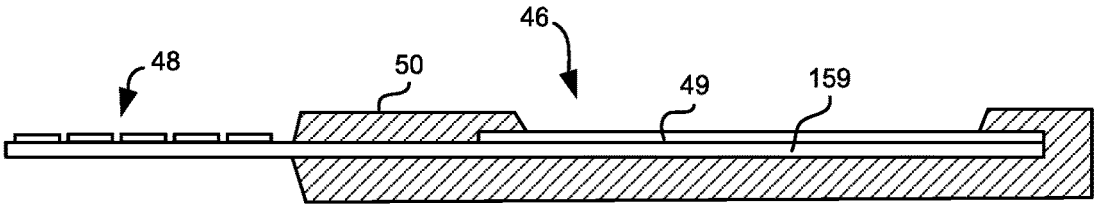
Figure 15D:
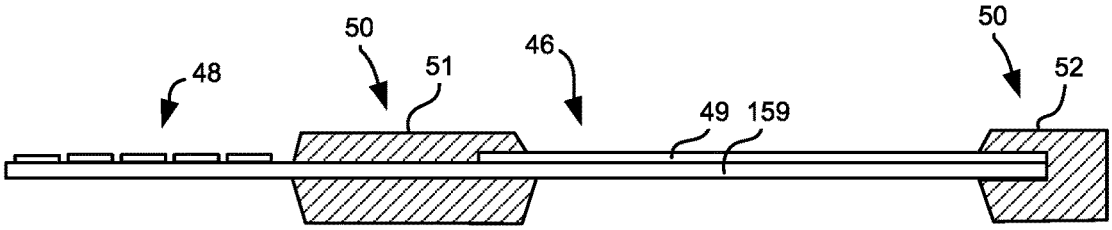

FIG. 15B shows the ECA 159 of FIG. 15A inside a mold with a top mold 304 and a bottom mold 306. The support structure 352 may be made of a compound the same as used in the transfer molding or in other examples may be made of a material that provides a better thermal coefficient of expansion similar to the material of the ECA 159. In another example, the support structure can be provided by the supporting topographies as part of the bottom mold cavity. FIG. 15C shows the finished fluid property sensor 46 with a compound support member 356 packaged into packaged encasement 50. FIG. 15D shows the finished fluid property sensor 46 when a removable support 354 is used and removed after overmolding. This process may be used to create a fluid property sensor 46 with a first packaged section 51 and a second packaged section 52, such as shown in FIG. 5A. As with the other processes, the ECA 159 may be formed in an ECA panel with an array of ECAs 159 and the overmolding process performed on the ECA panel prior to singulation of the finished fluid property sensor 46.

Figure 16:
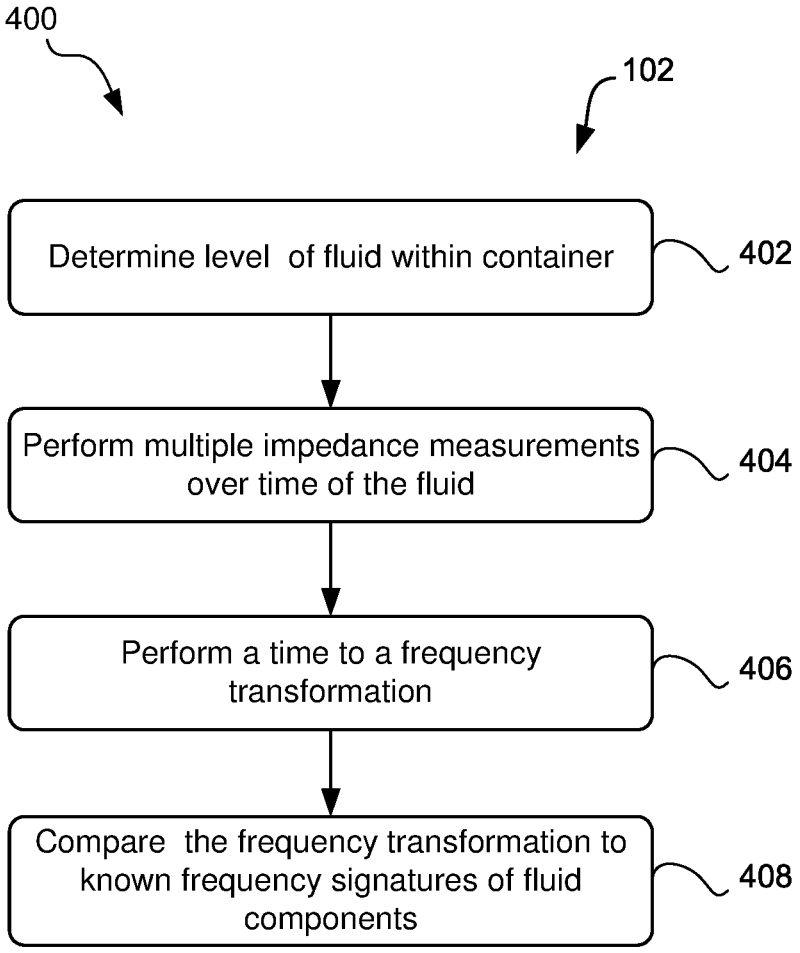
FIG. 16 is a flowchart of an example fluid sensing routine in FIG. 1.

FIG. 16 is a flowchart of an example fluid sensing routine 102 (FIG. 1). The fluid sensing routine 102 may be performed by software or hardware or a combination of both. Routines may constitute either software modules, such as code embedded in a tangible non-transitory machine-readable medium 120 or hardware modules. A hardware module, such as controller 100 and/or driver circuit 204, is a tangible unit capable of performing certain operations and may be configured or arranged in certain manners. In one example, one or more computer systems or one or more hardware modules of a computer system may be configured by software (e.g., an application, or portion of an application) as a hardware module that operates to perform certain operations as described herein. In some examples, a hardware module may be implemented as electronically programmable. For instance, a hardware module may include dedicated circuitry or logic that is permanently configured (e.g., as a special-purpose processor, state machine, a field programmable gate array (FPGA) or an application specific integrated circuit (ASIC)) to perform certain operations. A hardware module may also include programmable logic or circuitry (e.g., as encompassed within a general-purpose processor or another programmable processor) that is temporarily configured by software to perform certain operations.

In block 402, the level or location of the fluid is determined within a fluid container. The level can be determined by using thermal impedance sensors and/or electrical impedance sensors to detect a fluid/air boundary. In block 404, multiple impedance measurements are made over time of the fluid. The impedance measurements may be made by using thermal impedance sensors and/or electrical impedance sensors. In block 406, the multiple impedance measurements are used to perform a time to frequency transform, such as a Fast Fourier Transform, a Cosine transform or other time to frequency transform. In block 408, the output of the frequency transform is then used to compare with various frequency signatures of known fluid components to determine the chemical makeup of the fluid as threshold indications of various chemicals or chemical properties.

Accordingly, a fluid container 40 includes a package containing a chamber 22 or fluid reservoir 44 for containing a fluid. A fluid property sensor 86 may include a sensing portion extending into the chamber 22, 44. The sensing portion may include a fluid property sensor 46 to communicate a fluid level 43, and a chemical property sensor to communicate a chemical makeup of the fluid. An interface portion may share a common interface bus 83 with the sensing portion and include an analog interface (Sense signal), a digital interface (Data and Clock signals), and an external interface 48 exposed outside the package and electrically coupled to the common interface bus 83. The Sense signal may also be used as a digital signal on the digital interface. A driver circuit 204 may be coupled to the common interface bus 83 to communicate with the fluid property sensor 46 and the chemical property sensor 85 and communicate characteristics of the fluid property sensor 46 and the chemical property sensor 85 on the analog interface and communicate threshold indications of the fluid level 43 and the chemical makeup on the digital interface. The sensing portion and the interface portion may be packaged together to form the fluid property sensor 86.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document. For irreconcilable inconsistencies, the usage in this document controls.

While the claimed subject matter has been particularly shown and described with reference to the foregoing examples, those skilled in the art will understand that many variations may be made therein without departing from the intended scope of subject matter in the following claims. This description should be understood to include all novel and non-obvious combinations of elements described herein, and claims may be presented in this or a later application to any novel and non-obvious combination of these elements. The foregoing examples are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A fluid property sensor, comprising:

an electrical circuit assembly (ECA);

a plurality of elongated circuits (ECs) attached to the ECA, each respective EC of the plurality of ECs having multiple point sensors distributed along a length of the respective EC, wherein the plurality of ECs are daisy-chained and staggered with respect to one another;

an external interface electrically coupled to a proximal end of a first EC of the plurality of ECs, wherein the first EC and the external interface are packaged together with an encasement on both sides of the ECA to form the fluid property sensor.

2. The fluid property sensor of claim 1, wherein the encasement is formed in multiple separate portions of the fluid property sensor.

3. The fluid property sensor of claim 2, wherein the multiple separate portions of the encasement comprises a first encasement portion at a proximal end of the fluid property sensor, and a second encasement portion at a distal end of the fluid property sensor.

4. The fluid property sensor of claim 1, wherein the ECA is to electrically connect the plurality of ECs to a common interface bus, and wherein the encasement encases a support for the ECA.

5. The fluid property sensor of claim 1, wherein the first EC is a proximal EC, and the plurality of ECs further comprise a distal EC and a mesial EC disposed between the proximal EC and the distal EC, and wherein the proximal EC, the distal EC, and the mesial EC are packaged within the encasement.

6. The fluid property sensor of claim 5, wherein an EC of the proximal EC, the distal EC, and the mesial EC includes a higher density of fluid property sensors than another EC of the proximal EC, the distal EC, and the mesial EC.

7. The fluid property sensor of claim 1, wherein the multiple point sensors of each EC of the plurality of ECs is within a respective opening of the encasement.

8. The fluid property sensor of claim 1, wherein the encasement protects wire interconnects of the external interface while exposing the multiple point sensors of each EC of the plurality of ECs to a fluid of a fluid container.

9. The fluid property sensor of claim 1, further comprising:

an electrical interface to electrically connect the first EC and a second EC of the plurality of ECs, wherein the second EC is separate from the first EC, and the ECA has a width and the first EC and the second EC are staggered with respect to one another along the width of the ECA so that the first EC is offset with respect to the second EC along the width of the ECA.

10. The fluid property sensor of claim 1, wherein the encasement spans a length of the fluid property sensor.

11. A fluid container, comprising:

a package containing a chamber for containing a fluid; and a fluid property sensor comprising:

a sensing portion extending into the chamber, the sensing portion including:

multiple integrated circuits (ICs) sharing a common interface bus;

an electrical circuit assembly (ECA);

a plurality of elongated circuits (ECs) attached to the ECA, each respective EC of the plurality of ECs having multiple point sensors exposed to the chamber and distributed along a length of the respective EC, wherein the plurality of ECs are daisy-chained and staggered with respect to one another; and an interface portion exposed outside the package and including an external interface electrically coupled to a proximal end of the sensing portion, wherein the multiple ICs and the external interface are packaged together with an encasement to form the fluid property sensor.

12. The fluid container of claim 11, wherein the encasement is formed on both sides of the fluid property sensor.

13. The fluid container of claim 11, wherein the encasement is formed in multiple separate portions of the fluid property sensor.

14. The fluid container of claim 11, wherein the ECA electrically connects the plurality of ECs to the common interface bus, wherein the encasement encases a support for the ECA.

15. The fluid container of claim 11, wherein the multiple point sensors of each EC of the plurality of ECs is within an opening of the encasement.

16. The fluid container of claim 11, wherein the plurality of ECs comprise a first EC and a second EC separate from the first EC, and wherein the fluid property sensor further comprises:

an electrical interface to electrically connect the first EC and the second wherein the ECA has a width and the first EC and the second EC are staggered with respect to one another along the width of the ECA so that the first EC is offset with respect to the second EC along the width of the ECA.

17. A method of making a fluid property sensor, comprising:

placing an elongated circuit (EC) on an electrical circuit assembly (ECA) having an external electrical interface;

placing a driver circuit on the ECA;

wire bonding the EC and the driver circuit to the ECA;

encapsulating the wire bonding with a coating; and overmolding an encasement on a top surface with a top mold and on a bottom surface of the ECA with a bottom mold while exposing a sensing portion of the EC with no encasement.

18. The method of claim 17, further comprising:

forming a support topography on the bottom mold; and forming a chase in the top mold to seal off the sensing portion of the EC during overmolding.

19. The method of claim 17, further comprising placing a support member disposed under the ECA, the EC, and the driver circuit prior to the overmolding.

20. The method of claim 19, further comprising removing the support member after the overmolding, wherein the overmolding creates multiple separate overmolding regions.

* * * * *